United States Patent [19]

Harada

[11] Patent Number: 4,781,116

[45] Date of Patent: Nov. 1, 1988

[54] WASHING METHOD AND APPARATUS FOR GUIDE ROLLERS OF ROTARY PRESS

[75] Inventor: Matsuo Harada, Tokyo, Japan

[73] Assignee: Nikka Kabushiki Kaisha, Tokyo, Japan

[21] Appl. No.: 43,351

[22] Filed: Apr. 28, 1987

[30] Foreign Application Priority Data

Apr. 28, 1986 [JP] Japan ..... 61-98695
Apr. 30, 1986 [JP] Japan ..... 61-100526

[51] Int. Cl.[4] ..... B41F 35/00
[52] U.S. Cl. ..... 101/425; 101/423
[58] Field of Search ..... 101/423, 424, 425, 417, 101/418, 228, 156, 168

[56] References Cited

U.S. PATENT DOCUMENTS 419,017 1/1890 Hawkins ..... 101/423
427,318 5/1890 Hawkins ..... 101/423
879,443 2/1908 Cottrell ..... 101/424
965,117 7/1910 Muller-Fichter ..... 101/424
3,467,008 9/1969 Domotor ..... 101/425

*Primary Examiner*—Edgar S. Burr
*Assistant Examiner*—James Lisehora
*Attorney, Agent, or Firm*—Fleit, Jacobson, Cohn & Price

[57] ABSTRACT

A rotary press is operated slowly while paper is fed to the rotary press. A washing liquid is applied to the printing paper throughout substantially its entire width to wet the printing paper, and a plurality of guide rollers that are in contact with the travelling paper on the paper discharge side with respect to a printing portion are rotated at a peripheral speed different from that of the travelling paper so that contamination of the guide rollers is wiped off by the travelling paper. The washing apparatus of the invention has a plurality of guide roller driving devices which can drive and rotate the guide rollers at a peripheral speed different from that of the travelling paper.

8 Claims, 2 Drawing Sheets

WASHING METHOD AND APPARATUS FOR GUIDE ROLLERS OF ROTARY PRESS

BACKGROUND OF THE INVENTION

The present invention relates to a method of automatically removing any contamination of a large number of guide rollers disposed on a paper discharge side with respect to a printing portion of a rotary press, and more particularly, the present invention affords a washing method for guide rollers which applies a washing liquid to printing paper, brings the printing paper into sliding contact and provides a difference in their relative speed to wipe off contamination.

Further, the present invention relates to an apparatus for automatically removing any contamination of the guide rollers, and more particularly, the present invention affords a guide roller washing apparatus which utilizes printing paper as such, applies a washing liquid to the printing paper, brings the paper into contact with the guide rollers, provides a difference of relative speed between the paper and the guide rollers, and wipes off contamination.

Rotary presses for newspaper generally employ a construction in which three to four printing units are juxtaposed with one another. FIG. 2 of the accompanying drawings illustrates partially one example. Only two printing units are shown in the drawing for simplifying the illustration. Each printing unit 10 is equipped with a printing portion 16 consisting of a blanket cylinder 12 and the like, and a paper feed portion 20 which supports wound newsprint paper 18. Travelling paper 22 pulled out from the paper feed portion 20 reaches the printing portion 16 while being guided by a plurality of guide rollers 24, where it is printed, and is further guided by a plurality of guide rollers 26 to a folding machine (not shown), where the printed paper is cut and folded.

Generally, from 15 to 20 guide rollers 26 are disposed on the paper discharge side of the printing portion 16, or in other words, between the printing portion 16 and the folding machine. Since these guide rollers 26, particularly four to six guide rollers near the printing portion 16, come into contact with the travelling paper immediately after printing, large quantities of printing ink and paper dust attach to them. The guide rollers 26 are chromium-plated in a smooth condition, but the printing ink and paper dust are unavoidably attached thereto. Thus, they are contaminated unavoidably in the course of printing of large quantities of paper.

When the guide rollers 26 are contaminated, the paper surface gets dirty and since the attached and solidified foreign matters generate corrugation on the paper surface, longitudinal creases are likely to occur on the travelling paper and the quality of the printed matter drops seriously.

Therefore, the contamination of the guide rollers must be cleaned and wiped off at the time of replacement of printing plates or at the finish of printing. Cleaning devices have already been developed to automatically wash and clean a blanket drum, but suitable washing devices have not yet been developed for a large number of guide rollers. For this reason, they must be washed and cleaned manually at present.

In the case of a rotary press of newspaper having three to four printing units, the printing work is carried out generally by four to six workers. In this case, from about 15 to 20 minutes are necessary for three to four workers to wash the guide rollers so that the loss in time and economy is extremely great. Since the workers must enter the complicated inside of the rotary press to which the printing ink attaches, the body and clothes get dirty and the washing work is not pleasant. Moreover, the washing work is dangerous because it must be carried out sometimes at a high place.

SUMMARY OF THE INVENTION

An object of the present invention is to provide a washing method for guide rollers of a rotary press, which can eliminate the drawbacks of the prior art technique described above and can automatically wipe off the contamination of the guide rollers of a rotary press within a short period of time.

Another object of the present invention is to provide a washing method for guide rollers of a rotary press, which eliminates the manual wipe-off work inside the narrow and complicated rotary press.

A further object of the present invention is to provide a washing method for guide rollers of the rotary press, which can provide the great effects in the improvement of printing quality, reduction of the washing time and the improvement of safety of work.

Another object of the present invention is to provide a washing apparatus for guide rollers of a rotary press, which can be made relatively simple in construction and does not have a large space requirement.

A further object of the present invention is to provide a washing apparatus for guide rollers of a rotary press, which can be assembled sufficiently into existing rotary presses.

Another object of the present invention is to provide a washing apparatus which can eliminate the drawbacks of the prior art technique described above and can automatically wipe off the contamination of the guide rollers of a rotary press within a short period of time.

In the washing method according to the present invention, a rotary press is operated slowly while paper is fed to the rotary press, a washing liquid is applied to the printing paper throughout substantially its entire width to wet the printing paper, and a plurality of guide rollers that are in contact with the travelling paper on the paper discharge side with respect to a printing portion are rotated at a peripheral speed different from a speed of the travelling paper so that contamination of the guide rollers is wiped off by the travelling paper.

Here, the washing liquid is preferably intermittently applied a plurality of times. The application mechanism for the washing liquid and the driving mechanism for rotating the guide rollers are quite arbitrary.

A washing liquid is applied to travelling paper while a rotary press is operated slowly at a low and safe speed for checking and adjusting each portion of the press. The travelling paper thus wetted by the washing liquid reaches the guide rollers on the paper discharge side with respect to a printing portion. When the guide rollers are rotated at a peripheral speed different from a speed of the travelling paper, the travelling paper slips on the surface of the guide roller so that the printing ink and the like that have attached and solidified to the guide rollers surface are dissolved by the washing liquid contained in the travelling paper. Thereafter, the dry portion, where the washing liquid does not attach, come into sliding contact with the guide rollers to that the printing ink and the like that have thus been dissolved is transferred to the travelling paper and the contamination is wiped off. Since the surface of the guide rollers is kept in an extremely smooth condition by chromium plating or the like as described already, the contamination can be wiped off extremely easily when the travelling paper slips.

In the washing apparatus according to the present invention, a washing liquid application device is positioned on a paper feed side relative to contaminated guide rollers and applies a washing liquid to the travelling paper. Each guide roller driving device is disposed for each of a plurality of guide rollers disposed on a paper discharge side relative to the printing portion, particularly for four to six guide rollers immediately after printing, and can drive and rotate each guide roller at a peripheral speed different from the speed of the travelling paper.

The washing liquid is applied to the travelling paper by the washing liquid application device while the rotary press is operated slowly at a low and safe speed for checking and adjusting each portion of the press. The travelling paper thus wetted by the washing liquid reaches the guide rollers on the paper discharge side relative to the printing portion. Since the guide rollers are rotated at a peripheral speed different from a speed of the travelling paper by the guide roller driving device, the travelling paper slips on the surface of the guide roller so that the printing ink and the like that have attached and solidified to the guide roller surface are dissolved by the washing liquid contained in the travelling paper. Therafter, the dry portion where the washing liquid does not attach comes into sliding contact with the guide rollers so that the printing ink and the like that have thus been dissolved is transferred to the travelling paper and the contamination is wiped off. Since the surface of the guide rollers is kept in an extremely smooth condition by chromium plating or the like as described already, the contamination can be wiped off extremely easily when the travelling paper slips. Thus, the guide rollers can be washed automatically.

PREFERRED EMBODIMENTS OF THE INVENTION

Figure 1:
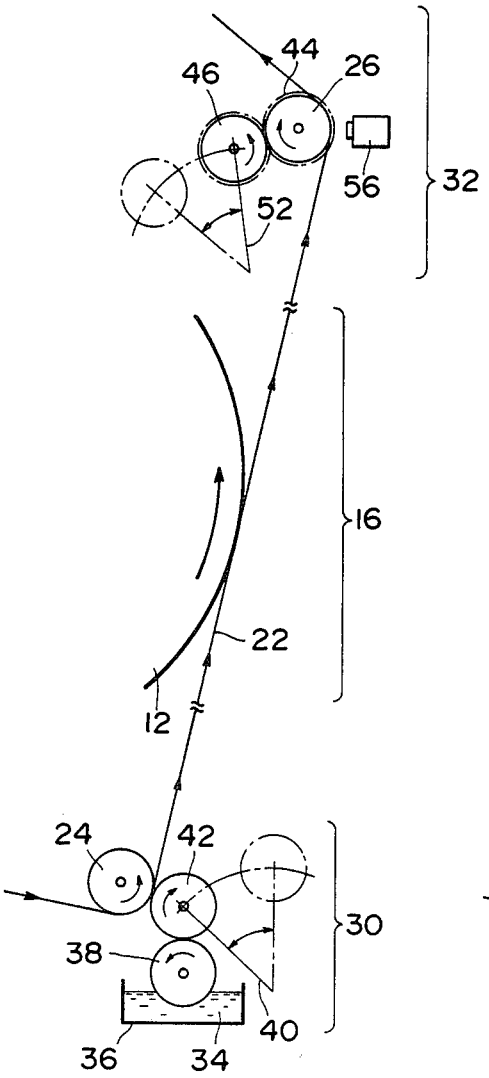
FIG. 1 is an illustration showing one embodiment of a guide roller washing apparatus in accordance with the present invention.

Referring to FIG. 1, a washing apparatus has a washing liquid application devices 30, a plurality of guide roller driving device 32 and, although not shown, a control device for controlling the operations of these devices and a washing liquid tank.

Figure 2:
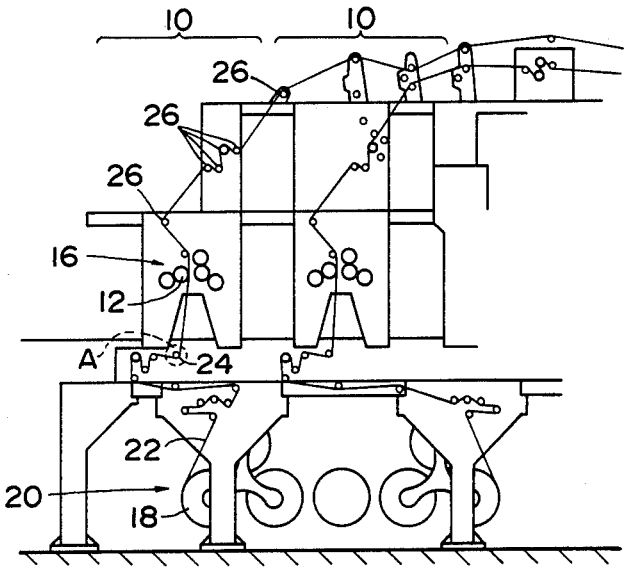
FIG. 2 is a partial explanatory view showing a schematic construction of a rotary press, the rotary press being known.

The washing liquid application device 30 is mounted to the rotary press on the paper feed side relative to its printing portion 16 (for example, to the lower part of a platform, represented by symbol A in FIG. 2). The washing liquid application device 30 has a washing liquid tank 36 storing therein a washing liquid 34, a fountain roller 38 which is disposed at its lower part into the washing liquid and is rotated, and a coat roller 42 which is supported by an arm 40 so that it can swing and simultaneously come into and get out of contact from both the travelling paper 22 and the fountain roller 38.

Figure 3:
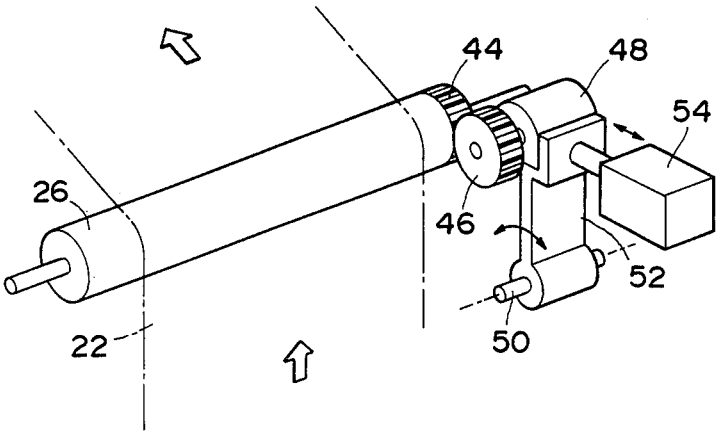
FIG. 3 is an explanatory view of one example of a guide roller driving device.

The guide roller driving device 32 is provided to each guide roller 26 on the paper discharge side relative to the printing portion 16 and drives and rotates each guide roller 26 at a peripheral speed which is different from that of the travelling paper 22. As shown in further detail in FIG. 3, the guide roller driving device 32 is constructed, for example, by forming a gear portion 44 at the end portion of the guide roller 26, fitting a transmission gear 46 meshing with the gear portion 44 to the rotor shaft of a motor 48, supporting the motor 48 on an arm 52 which is pivotally supported by a shaft 50, and engaging and disengaging the gear portion 44 and the transmission gear 46 with each other by an air cylinder 54.

The washing device of the present invention includes a rotation sensor 56 which is disposed in the proximity of each guide roller 26 in order to detect the rotation of the guide roller, as shown in FIG. 1.

The washing device having the construction described above is operation in the following way. While the paper is set for printing to the rotary press, the back-tension by the paper feed portion 20 is reduced or released and the press is operated slowly so that the travelling paper is easily pulled by a folding machine (not shown). Generally, when the paper is set for printing, a force ranging from 10 to 20 kg is applied. Since the guide rollers 26 are driven at a relative speed which is different from the speed of the travelling paper 22, it may become difficult to run the paper. In this case, the back-tension by the paper feed portion 20 is reduced.

If a pulling force of the driving roller disposed within or adjacent to the folding machine is strong enough, the back-tension by the paper feed portion 20 can be maintained.

Next, the coat roller 42 is rocked and its surface is brought into contact with the fountain roller 38 and the travelling paper 22. Then, the washing liquid 34 in the washing liquid tank 36 is attached to the surface of the fountain roller 38 due to its rotation and conveyed and applied to the travelling paper 22 through the coat roller 42. Though depending upon the contamination degree of the guide rollers 26, the rocking operation of the coat roller 42 is preferably effected dividedly and intermittently several times. Moreover, it is preferred that the coating time is longer at the initial state or otherwise the time interval between the coating operation and the next operation is shorter at the initial stage and longer at the later stages.

Since petroleum type solvents are used generally as the washing liquid, the tensile strength of the printing paper hardly drops even when such a solvent is applied thereto.

The travelling paper, to which the washing liquid is thus attached, reaches then the contaminated guide rollers 26. Generally, a large number of guide rollers 26 are assembled and the guide rollers to be used are selected depending upon the printing condition. In other words, the travelling paper does not always pass through all the guide rollers of the rotary press and the guide rollers are selected in accordance with the printing condition or the like, thereby determining the travelling route of the printing paper. The rotary sensor 56 detects the rotation of the guide roller 26 and judges whether or not the guide roller is the guide roller that is being used actually at present. As to the guide roller 26 to be washed (or the guide roller that is being used at present), the transmission gear 46 is meshed with the gear portion 44 of the guide roller and the guide roller 26 is then rotated at a suitable speed by the driving motor 48. Since the rotary press is operated slowly at about 15 to 20 rpm, there occurs no problem even when the transmission gear 46 is abruptly placed into a meshed relation with the gear portion 44. It is sufficient that the guide roller 26 is rotated by the motor 48 so that the guide roller 26 has a relative speed with the travelling paper 22, and the rotating speed of the guide roller 26 may be either higher or lower than that of the travelling paper. Accordingly, the guide roller 26 may be rotated either normally or reversely. Since the rotation may be at a low speed, the motor may be of a small and low output type.

The printing ink attaching to the guide roller is dissolved when the travelling paper 22 which contains the washing liquid to form wet portions comes into contact with the guide roller, and the dry travelling paper portion that comes next wipes off the contamination of the dissolved ink. When this washing operation is repeated several times, the contamination can be wiped off extremely easily because the surface of the guide roller is chromium-plated and is smooth. After the wiping operation is complete, the transmission gear 46 is returned to the original position by the air cylinder 54 and the motor 46 is stopped. Then, the guide rollers 26 return to their original free rotation state and can rotate at the speed of the travelling paper.

Although the present invention has thus been described with reference to one preferred embodiment thereof, the invention is not naturally limited thereto, in particular. Though the position of each washing liquid application device is preferably on the paper feed side relative to the printing portion as in the embodiment described above, it may be disposed on the paper discharge side relative to the printing portion depending upon rotary presses employed. In such a case, it is positioned on the paper feed side with respect to the contaminated guide roller which is positioned closest to the printing portion and is being used at present.

Figure 4:
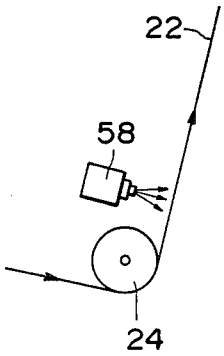
FIG. 4 is an explanatory view showing another embodiment of a washing liquid application device.

The washing liquid may be sprayed directly to the travelling paper by disposing, for example, a washing liquid spray bar 58 in such a manner as to face the travelling paper 22 as shown in FIG. 4. If necessary, the washing liquid may be applied not only from one side but also from both sides of the travelling paper. The timing and quantity of application of the washing liquid are controlled automatically by the control device (not shown).

Though the washing liquid may be applied continuously, it is preferably applied intermittently as in the embodiment described above so that the wet portions and the dry portions come alternately into sliding contact with the guide rollers. Though the rotation sensor is disposed preferably for each guide roller in order to drive, rotate and wash only the necessary guide roller which is being used at present, all the guide rollers equipped with the guide roller driving device are simultaneously driven for rotation at times without the rotation sensors. The rocking motion or reciprocation of the transmission gear, the motor and the coat roller can be effected by use of arbitrary mechanisms. It is possible to employ not only the air cylinder but also electromagnetic plungers.

In accordance with the present invention, the washing liquid is applied to the travelling paper, and a plurality of guide rollers on the paper discharge side with respect to the printing portion are rotated at a relative speed with respect to the travelling paper in order to wipe off the contamination. Accordingly, from the apparatus aspect, the washing apparatus can be relatively simple and does not require a large space. The washing method of the present invention permits elimination of the manual operation of wipe-off work inside the narrow and complicated rotary press.

In the present invention, the washing liquid application device is disposed on the side or stage of paper-feed relative to the contaminated guide rollers, and a plurality of guide roller driving devices are disposed on the side or stage of paper-discharge relative to the printing portion. Thus, the washing apparatus is relatively simple in construction and does not need a large space requirement and can be assembled sufficiently into existing rotary presses.

Further, according to the washing apparatus of the present invention, the washing work can be made by the use of the paper remaining after printing and, accordingly, it eliminates the trouble of fitting a non-woven fabric or the like for cleaning. Therefore, the guide rollers can be automatically washed. Thus, the present invention provides extremely excellent effects in the improvement of safety of the washing work.

Particularly when the washing apparatus of the present invention is combined with a blanket washing device or the like to simultaneously wash and clean each portion of the rotary press, the loss of time and paper can be reduced and the washing liquid tank can be used in common.

The foregoing description illustrates specific embodiment within the scope of the present invention and is not to be construed as limiting the scope of the invention. It is to be understood that variations and modifications thereof may be made by those skilled in the art without departing from the scope of the invention.

What is claimed is:

1. A method of washing guide rollers of a rotary press comprising the steps of:

operating said rotary press slowly while printing paper is fed under an initial pulling force and at an initial back-tension to said rotary press, applying a washing liquid to said printing paper, while said printing paper is travelling, across substantially an entire width of the printing paper to partly wet said printing paper, guiding said travelling printing paper through the rotary press by guide rollers, maintaining a plurality of guide rollers in contact with said travelling printing paper on a paper discharge side with respect to a printing portion of said rotary press, and rotating said plurality of guide rollers at a peripheral speed different from a speed of said travelling printing paper so that contamination of said guide rollers is wiped off by said travelling printing paper.

2. A method of washing guide rollers of a rotary press according to claim 1, and further comprising the step of:

reducing the back-tension of a paper feed portion of said rotary press below said initial back-tension if it becomes difficult for said printing paper to travel.

3. A method of washing guide rollers of a rotary press according to claim 1, and further comprising the step of:

increasing the pulling force under which said printing paper is fed above said initial pulling force to maintain the back-tension of a paper feed portion of said rotary press.

4. A method of washing guide rollers according to claim 1, and further comprising the step of:

intermittently applying said washing liquid a plurality of times.

5. A method of washing guide rollers of a rotary press according to claim 1, wherein said washing liquid is a petroleum type solvent.

6. An apparatus for washing guide rollers of a rotary press comprising:

guide rollers, a printing portion, travelling paper contacting and guided by said guide rollers through the rotary press, washing liquid application means for applying a washing liquid to the travelling paper on a paper feed side of the printing portion with respect to contaminated guide rollers of said rotary press, and guide roller driving means for driving and rotating said contaminated guide rollers on a paper discharge side of said printing portion at a peripheral speed different from a speed of said travelling paper.

7. An apparatus for washing guide rollers according to claim 6, wherein said washing liquid application means comprises a washing tank containing therein a washing liquid, a fountain roller device disposed for rotation at a lower part of the washing liquid application means in the washing liquid, and a coat roller device supported swingably so that said coat roller can swing into and out of contact with both said travelling paper and said fountain roller device.

8. An apparatus for washing guide rollers according to claim 6, wherein said washing liquid application means has a washing spray bar for directly spraying the washing liquid on the travelling paper.

* * * * *